US008186273B2

(12) United States Patent
Trivette

(10) Patent No.: US 8,186,273 B2
(45) Date of Patent: May 29, 2012

(54) PLASTIC AMMUNITION CASING AND METHOD

(76) Inventor: Roger Blaine Trivette, Boiling Springs, SC (US)

( * ) Notice: Subject to any disclaimer, the term of this patent is extended or adjusted under 35 U.S.C. 154(b) by 241 days.

(21) Appl. No.: 12/387,526

(22) Filed: May 4, 2009

(65) Prior Publication Data

US 2010/0275804 A1 Nov. 4, 2010

(51) Int. Cl.
*F42B 7/06* (2006.01)
*F42B 5/30* (2006.01)

(52) U.S. Cl. ..... 102/465; 102/448; 102/466; 102/514; 102/430

(58) Field of Classification Search ..... 102/464–467, 102/469–471, 514–516, 430, 444, 449
See application file for complete search history.

(56) References Cited

U.S. PATENT DOCUMENTS

| | | | | | |
|---|---|---|---|---|---|
| 2,862,446 | A | * | 12/1958 | Ringdal | 102/430 |
| 3,026,803 | A | * | 3/1962 | Metzger | 102/466 |
| 3,088,405 | A | * | 5/1963 | Clark, Jr. | 102/466 |
| 3,099,958 | A | | 8/1963 | Daubenspeck et al. | 102/42 |
| 3,162,124 | A | * | 12/1964 | Miller | 102/449 |
| 3,609,904 | A | | 10/1971 | Scanlon | 42/76 |
| 3,765,297 | A | * | 10/1973 | Skochko et al. | 89/1.1 |
| 3,935,816 | A | | 2/1976 | Boquette, Jr. | 102/41 |
| 4,140,058 | A | | 2/1979 | Ballreich et al. | 102/43 |
| 4,187,271 | A | * | 2/1980 | Rolston et al. | 264/258 |
| 4,192,233 | A | * | 3/1980 | Dumortier | 102/466 |
| 4,569,288 | A | | 2/1986 | Grelle et al. | 102/466 |
| 4,593,621 | A | | 6/1986 | Buchner | 102/430 |
| 4,809,612 | A | | 3/1989 | Ballreich et al. | 102/466 |
| 4,846,068 | A | | 7/1989 | Zedrosser | 102/430 |
| 6,845,716 | B2 | | 1/2005 | Husseini et al. | 102/466 |
| 7,059,234 | B2 | | 6/2006 | Husseini | 86/55 |
| 7,610,858 | B2 | * | 11/2009 | Chung | 102/466 |
| 2007/0214992 | A1 | * | 9/2007 | Dittrich | 102/469 |

FOREIGN PATENT DOCUMENTS

EP 131863 A2 * 1/1985

* cited by examiner

*Primary Examiner* — Michael David
(74) *Attorney, Agent, or Firm* — Thomas L. Moses; Monahan & Moses, LLC

(57) ABSTRACT

Ammunition having an integrally formed, polymeric casing is provided. Plastic casings for ammunition may be made using injection molding processes for combat ammunition, target ammunition and blanks. The casings, in one embodiment, include a hollow tubular member with an open end and a closed end having an aperture for a primer cap. The base of the casing includes a conical shape within the tube that narrows toward the base. An annular groove and an annular rim are disposed about an outer periphery of the base. Plastic casings may be utilized for ammunition cartridges used in pistols, rifles and shotguns, and are lighter and less expensive to manufacture than traditional brass casings. Further, the polymeric casings may include any desired colorants to distinguish different calibers of ammunition by color, and the spent casings may be recyclable.

15 Claims, 3 Drawing Sheets

PLASTIC AMMUNITION CASING AND METHOD

BACKGROUND OF THE INVENTION

The present invention relates generally to novel cartridges for use in weapons of various types. More specifically, the present invention relates to a novel ammunition cartridge structure using a plastic casing, and a method for manufacturing the plastic casing.

Heretofore, ammunition casings have been manufactured primarily by using brass. However, the use of brass casings for ammunition has several significant drawbacks. First, the use of brass is costly, particularly when copper is in short supply, and that cost is passed along to the consumer. Secondly, the brass component of bullets adds significant weight to the bullet, which creates a significant burden to those who must carry large amounts of ammunition, particularly including hunters, members of the military, and law enforcement. Additionally, in order to prevent the deleterious effects that high humidity and other extreme environmental conditions may have on ammunition over time, costly protective measures must be adopted.

To overcome these disadvantages, other plastic bullet cases have been proposed, but each effort has resulted in its own set of problems. Some plastic casings have failed because the plastic component could not withstand the high temperatures associated with repeated, rapid firings, thus resulting in a melting or softening of the plastic during use. Other plastic ammunition casings are not strong enough to withstand the violent extraction action of the weapon, so that the casing fails structurally and fragment as it is being ejected from the weapon, which causes fragments of the casings then become lodged in the weapon. Further, many of the plastic casings that have been proposed include complicated designs requiring multiple, time consuming manufacturing steps. Thus, the plastic casings proposed to date have significant disadvantages, and have not been adopted on a mass commercial scale.

Therefore, it would be desirable to provide a method of producing a non-metallic, preferably plastic, ammunition casing that is simple and inexpensive to manufacture. Additionally, it would be desirable to provide a plastic ammunition casing using a polymeric material that has a high enough melting temperature to withstand the heat produced during the rigors of rapid automatic fire, and that is strong enough to be extracted from an automatic weapon without suffering structural failure. Such plastic bullet casings would provide a reduction in cost of training and combat ammunition, reduction in weight of ammunition with consequent logistic advantages, improved reliability, and reduced weapon jamming problems.

BRIEF SUMMARY OF THE INVENTION

In accordance with one aspect of the invention, ammunition is provided for use in connection with hand guns, rifles, semi-automatic and automatic weapons, machine guns, and the like, in which the casing is made from a polymeric material having a high melting point temperature and high structural integrity. Preferred materials used in the manufacture of the casing include polyphenylene sulfide containing fiberglass or polycarbonates. Other materials may be used, including nylons, polyethylene, polypropylene, and PET, among others. The shape of the casing, in one embodiment, is generally the same shape as ammunition having a brass casing, including a tubular body, an open end for receiving a projectile, and a substantially closed end having an annular groove around the periphery of the body at a lower end, thus defining an annular rim. An aperture is provided at or near the center of the substantially closed end for insertion of a primer cap.

The plastic casing may be manufactured by injection molding, preferably with a center gate to prevent knit lines. After the plastic casing has been formed, the primer cap is inserted into the aperture in the closed end, the propellant is placed within the tubular body and positioned adjacent the primer cap, and the projectile is fitted and secured into the open end of the tubular body of the casing, completing the process. It should be understood that the specific size and shape of the casing may be modified in accordance with the specifications of the weapon for which the ammunition is being manufactured, including the caliber, the end use, and desired effect contemplated for the projectile.

These types of plastic casings may used in conjunction with pistol, rifle and shotgun ammunition. It is contemplated that the instant plastic ammunition casings may be used for rounds of many different calibers and shapes, as well as for target rounds and blanks.

BRIEF DESCRIPTION OF THE DRAWINGS

These and other features, aspects, and advantages of the present invention will become better understood with regard to the following description, appended claims, and accompanying drawings where:

DETAILED DESCRIPTION OF THE INVENTION

Figure 3:
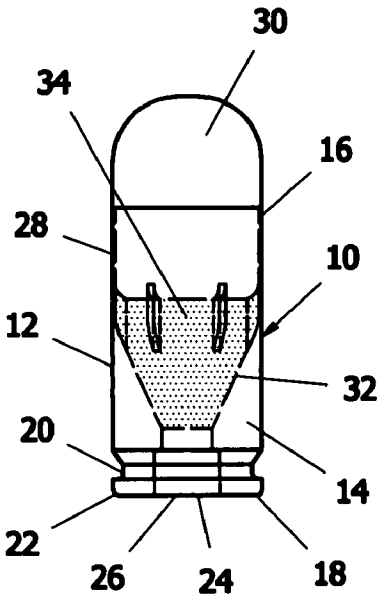
FIG. 3 is a longitudinal cross sectional view of one embodiment of an assembled round having a polymeric ammunition casing, a primer cap, propellant, and a projectile.
Figure 4:
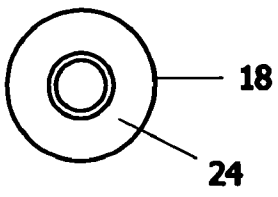
FIG. 4 is a bottom view of one embodiment of one embodiment of a polymeric ammunition casing.

A first embodiment of a plastic casing for ammunition is shown in FIGS. 1-4. In this embodiment, the plastic casing 10 includes a tubular body 12 with a conical shaped section 14 on a lower portion of an inner surface, an open end 16 for receiving a projectile, and a base 18 comprising a substantially closed end having an annular groove 20 around the periphery of the body 12 at a lower end, thus defining an annular extracting rim 22. As shown in FIG. 4, an aperture 24 is provided at or near the center of the base 18 for insertion of a primer cap 26. The aperture 24 is formed so that it is in communication with the apex of the conical section 14 at the base 18 of the casing 10. It is also contemplated that another similar embodiment may be manufactured without the annular groove, but including an extracting rim around the periphery of the base.

Figure 2:
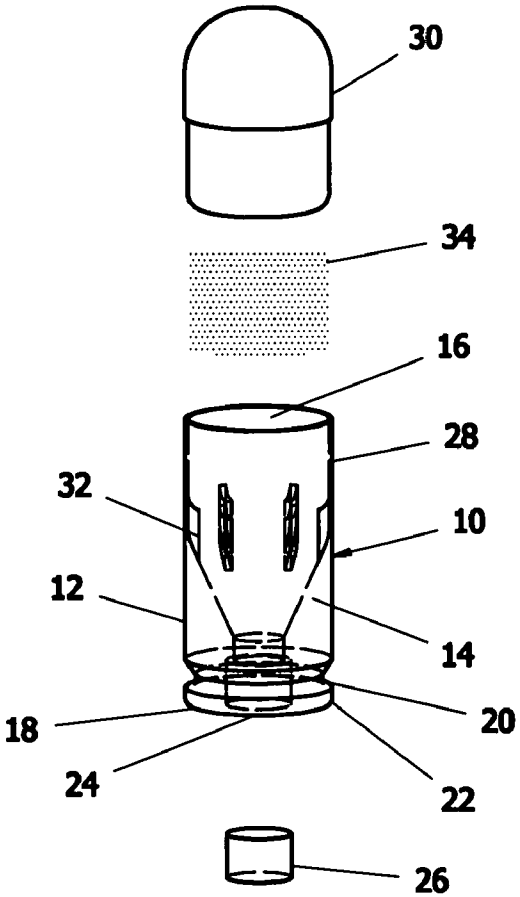
FIG. 2 is an exploded perspective view of one embodiment of a polymeric ammunition casing, a primer cap, propellant, and a projectile.
Figure 1:
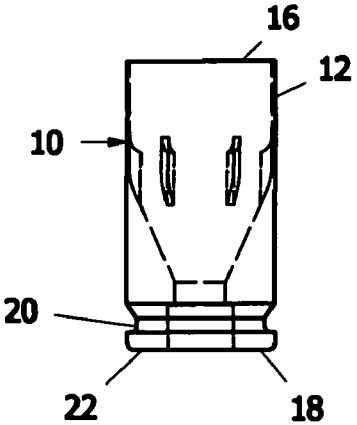
FIG. 1 is a side view of one embodiment of a polymeric ammunition casing.

FIGS. 1-3 show an integrally formed, polymeric casing 10 used in conjunction with pistol ammunition, wherein the casing 10 includes a thin wall 28 near the open end 16 of the casing 10, and wherein the inner wall of the casing 10 forms a conical shape 14, narrowing toward the base end 18. The conical shape 14 allows the majority of the blast force to be directed toward the open end 16 of the casing 10 with the projectile 30, which helps to maintain the structural integrity of the casing 10 during firing. Additionally, in a preferred embodiment, a series of evenly spaced ribs 32 or protrusions extend longitudinally along the inner surface of the casing 10. These ribs 32 extend between the thin wall 28 section of the casing 10 and the upper, wider end of the conical shape 14, and serve to strengthen the portion of the casing 10 where the thin wall 28 meets the cone shaped section 14. Further, the upper end of the ribs 32 also serves as a base or stop for insertion of the projectile 30, thus preventing the projectile 30 from becoming inserted too deeply into the casing 10 during the assembly or loading process.

As shown in FIGS. 2 and 3, a primer cap 26 is inserted and secured into the aperture 24 formed in the base member 18, and a propellant 34 is loaded into the tubular body 12 of the casing 10. Then, a projectile 30 is inserted or press fit into the open end 16 of the casing 10. The plastic casing 10 is designed so that it may be loaded similarly to standard reloading operations. Standard, off-the-shelf primer caps 26, propellant 34 and projectiles 30 may be utilized in conjunction with the plastic casings 10. Although in a preferred embodiment, the primer cap 26 and the projectile 30 are simply press fit and held in place within the casing 10 by frictional forces, it is contemplated that other attachment means could potentially be used, if necessary.

With respect to the propellant 34 used herein, a variety of propellant charge types are well known and can be considered to broadly include all suitable types of charges, including conventional propellant charges (gunpowder) and conventional explosive charges such as PYRODEX, a smokeless black powder substitute available from Hodgdon Powder Co., Inc. Shawnee Mission, Kans.

The projectile 30 may be any standard projectile formed from lead or other suitable materials. In one embodiment, the projectile 30 is formed of zinc or a zinc alloy, preferably die cast, and preferably having a copper jacket around the outside of the projectile. This arrangement avoids the use of lead, which is prohibited in many indoor shooting ranges.

In a preferred embodiment, the plastic casings are made from polyphenylene sulfide containing fiberglass or polycarbonate. However, other polymeric materials may be used, including nylon, polyethylene, polypropylene and PET, among others. The preferred method of manufacture for the plastic casings is injection molding, although other methods are contemplated, including milling. In the injection molding process, center gates may be utilized to prevent knit lines, thereby increasing the structural integrity of the casing 10.

Figure 5B:
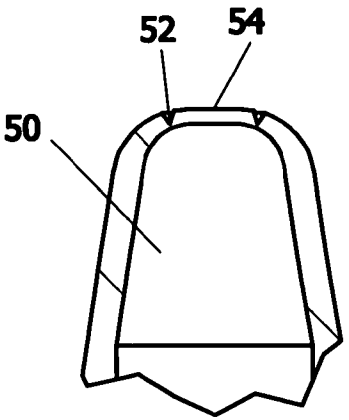
FIG. 5B is a cross sectional view of the tip of the polymeric ammunition casing shown in FIG. 5A.
Figure 5A:
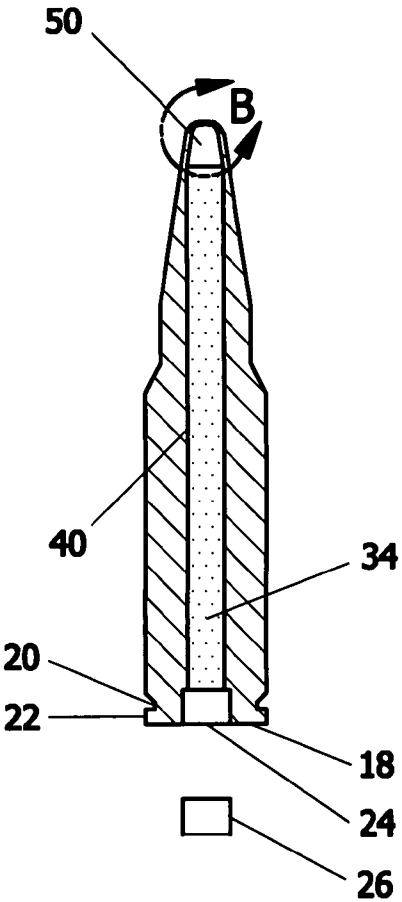
FIG. 5A is a cross sectional side view along the line A-A of the embodiment of the polymeric ammunition casing shown in FIG. 5.
Figure 5:
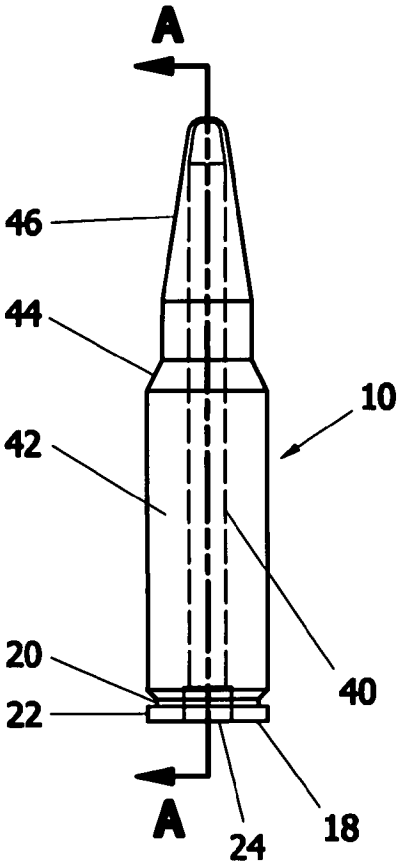
FIG. 5 is a side view of another embodiment of a polymeric ammunition casing for a blank having a tapered configuration.

In another embodiment, an ammunition blank having a tapered casing configuration to be used in conjunction with rifles is provided, as shown in FIGS. 5, 5A and 5B. The plastic casing 10 is integrally formed, including a body member 42 with a straight, hollow inner tubular member 40. Similarly to the pistol ammunition casing described herein, the base 18 of the rifle blank casing 10 forms an aperture 24 for a primer cap 26, and an integrally formed tip 50. The base 18 also includes an annular groove 20 around the periphery of the body at a lower end, thus defining an annular rim 22. The propellant 34 is placed into the hollow inner tube member 40, adjacent the primer cap 26. The tip 50, as shown in FIG. 5B, is formed with a circular groove 52 that encircles the cap 54 of the blank. When the blank is discharged, the cap 54 becomes detached along the circular groove 52.

The plastic casing 10 includes, in a preferred embodiment, a first tapered section 44, and a second tapered section 46 toward the tip 50. A straight cylindrical section is disposed between the first tapered section 44 and the second tapered section 46. It is contemplated that a projectile (not shown) may be included within the tip 50 of the casing 10.

This tapered plastic casing may also be integrally formed through an injection molding process, and then the primer cap 26 and the propellant 34 are added to form the final product. This arrangement allows the plastic casings to be used for ammunition having different shapes (particularly tapered shapes) and sizes.

Figure 6B:
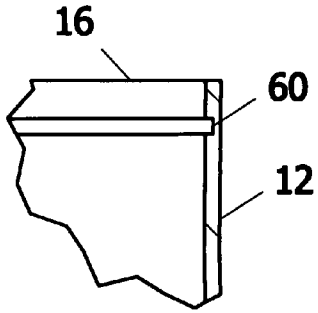
FIG. 6B is a sectional view of the open end and cap of the ammunition shotgun cartridge shown in FIG. 6A.
Figure 6A:
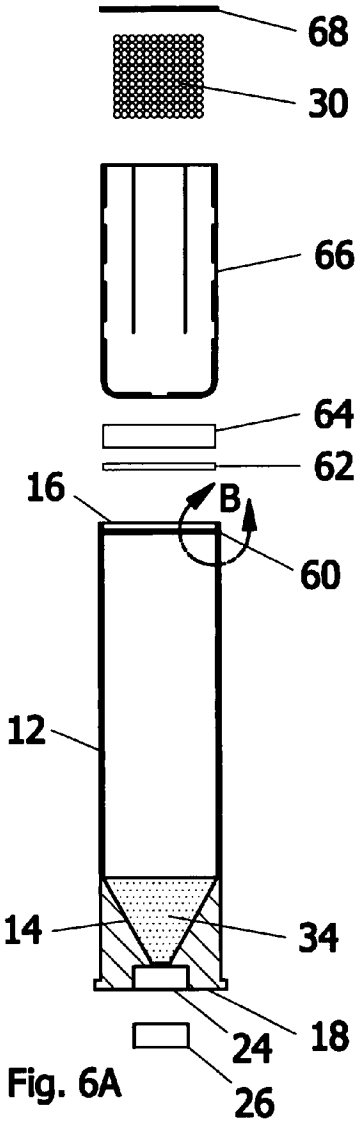
FIG. 6A is an exploded side view of the polymeric ammunition shotgun cartridge along the line A-A of FIG. 6.
Figure 6:
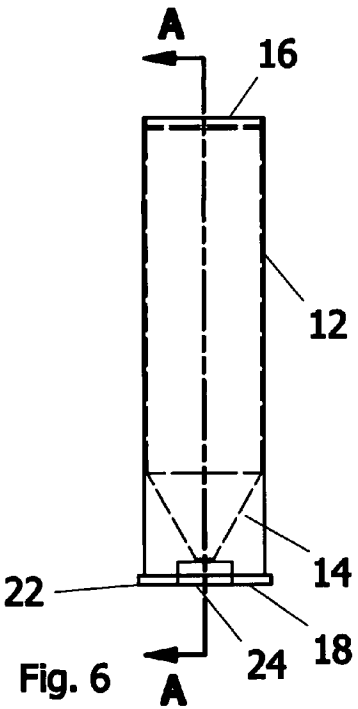
FIG. 6 is a side view of an embodiment of a polymeric ammunition shotgun cartridge.

It is also contemplated that integrally formed, polymeric casings may be used for shotgun shells, as shown in FIGS. 6, 6A and 6B. While most shotgun shells currently include a tubular portion that is made from plastic, the base member is typically made from brass or other metal. The integrally formed shotgun shells of the instant invention may be made similarly to the pistol casings described above, wherein the plastic casing includes a tubular portion 12 with a conical shape 14 narrowing toward the base 18. The base 18 includes an aperture 24 for receiving a primer cap 26. As shown in FIG. 6A, the propellant 34 is positioned within the conical section 14, adjacent the primer cap 26. In a preferred embodiment, a powder cap 62 is positioned adjacent the propellant 34, and wadding 64 is positioned adjacent the powder cap 62, as shown. A plastic shot cup 66 is provided adjacent the wadding 64, which serves to hold the projectile(s) 30 in place. Of course, the projectile 30, similarly to any shotgun ammunition, may include small shot (such as bird shot), larger shot (such as buck shot), or a slug. The open end 16 of the shotgun shell includes a circular inner groove 60, into which a cap 66 is placed (in one embodiment) to secure the contents within the shell, as shown in FIG. 6B. It is contemplated, however, that other methods may be used to close the open end 16 of the shotgun shell after the contents have been added. It is also contemplated that the contents of the shotgun shell may vary, for instance by using additional wadding, and such variations in the contents are well known in the art.

One advantage to using plastic or polymeric materials to form different types of ammunition casings is that different colorants may be added to the plastic to form the casings. Such an arrangement allows ammunition of different calibers to be color coded, so that ammunition of one caliber might be blue, while ammunition of another caliber might be red, yellow or clear, for instance. Additionally, it is contemplated that spent plastic casings may be recycled. After the spent primer caps are removed from the spent casings, the casings may be recycled into new casings, or into any other product that uses the material from which the casings are manufactured.

Although the present invention has been described in considerable detail with reference to certain preferred versions thereof, other versions are possible. Therefore, the spirit and scope of the appended claims should not be limited to the description of the preferred versions contained herein. All features disclosed in this specification may be replaced by alternative features serving the same, equivalent or similar purpose, unless expressly stated otherwise. Thus, unless expressly stated otherwise, each feature disclosed is one example only of a generic series of equivalent or similar features.

What is claimed is:

1. An integrally formed, non-metallic casing for ammunition comprising:

a hollow tubular member having an open end for receiving a projectile and a base member having a substantially closed end with an aperture for receiving a primer cap, wherein said tubular member includes a wall section having a uniform thickness adjacent said open end, and further including a conical shaped section within said tubular member adjacent said substantially closed end, so that the thickness of said hollow tubular member increases toward said base member, thus forming said conical shaped section;

an annular extracting rim formed about a periphery of said base member; and wherein said hollow tubular member, said base member and said annular extracting rim are formed of monolithic design from a non-metallic material.

2. The integrally formed, non-metallic ammunition casing set forth in claim 1, wherein said base member further defines an annular groove about an outer portion thereof, adjacent said extracting rim.

3. The integrally formed, non-metallic ammunition casing set forth in claim 1, wherein said casing is manufactured in an injection molding process.

4. The integrally formed, non-metallic ammunition casing set forth in claim 1, wherein said casing is made from material selected from the group consisting of polycarbonate, nylon, polyethylene, polypropylene, PET, and polyphenylene sulfide.

5. The integrally formed, non-metallic ammunition casing set forth in claim 1, further including a series of evenly spaced, longitudinally extending ribs positioned on an inner surface of said tubular member.

6. The integrally formed, non-metallic ammunition casing set forth in claim 5, wherein said ribs extend from an inner surface of said walled section of uniform thickness to an inner surface of said conical shaped section of said tubular member.

7. The integrally formed, non-metallic ammunition casing set forth in claim 1, wherein said casing is made from material containing a colorant.

8. An ammunition cartridge comprising: an integrally formed, non-metallic casing comprising a hollow tubular member having an open end for receiving a projectile connected to a base member having a substantially closed end with an aperture for receiving a primer cap and an annular extracting rim formed about a periphery of said base member; wherein said hollow tubular member, said base member and said annular extracting rim are formed of monolithic design from a non-metallic material a propellant positioned within said hollow tubular member; a primer cap inserted into said aperture in said base member; and a projectile secured within said open end of said tubular member, wherein said tubular member includes a wall section having uniform thickness adjacent said open end, and further including a conical shaped section within said tubular member adjacent said substantially closed end, so that the thickness of said tubular member gradually increases toward said base member, thus forming said conical shaped section.

9. The ammunition cartridge set forth in claim 8, wherein said base member further defines an annular groove about an outer portion thereof, adjacent said extracting rim.

10. The ammunition cartridge set forth in claim 8, wherein said integrally formed, non-metallic casing is manufactured using an injection molding process.

11. The ammunition cartridge set forth in claim 8, wherein said casing is made from material selected from the group consisting of polycarbonate, nylon, polyethylene, polypropylene, PET, and polyphenylene sulfide.

12. The ammunition cartridge set forth in claim 8, wherein said casing further includes a series of evenly spaced, longitudinally extending ribs positioned on an inner surface of said tubular member.

13. The ammunition cartridge set forth in claim 12, wherein said ribs extend from an inner surface of said walled section of uniform thickness to an inner surface of said conical shaped section of said tubular member.

14. The ammunition cartridge set forth in claim 8, wherein said casing is made from material containing a colorant.

15. The ammunition cartridge set forth in claim 8, wherein said projectile comprises zinc or a zinc alloy with a copper jacket around an outer periphery thereof.

* * * * *